US011462375B2

(12) United States Patent
Koletzko et al.

(10) Patent No.: US 11,462,375 B2
(45) Date of Patent: Oct. 4, 2022

(54) MAKE CONTACT SYSTEM

(71) Applicant: SIEMENS ENERGY GLOBAL GMBH & CO. KG, Munich (DE)

(72) Inventors: Martin Koletzko, Baiersdorf ot Igelsdorf (DE); Christian Schacherer, Deining (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/265,259

(22) PCT Filed: Jul. 24, 2019

(86) PCT No.: PCT/EP2019/069872
§ 371 (c)(1),
(2) Date: Feb. 2, 2021

(87) PCT Pub. No.: WO2020/025410
PCT Pub. Date: Feb. 6, 2020

(65) Prior Publication Data

US 2021/0304988 A1 Sep. 30, 2021

(30) Foreign Application Priority Data

Aug. 2, 2018 (DE) ..... 102018212953.3

(51) Int. Cl.
*H01H 33/662* (2006.01)
*H01H 33/664* (2006.01)
*H01H 33/666* (2006.01)

(52) U.S. Cl.
CPC .... *H01H 33/66261* (2013.01); *H01H 33/664* (2013.01); *H01H 33/666* (2013.01);
(Continued)

(58) Field of Classification Search
CPC ..... H01H 33/66261; H01H 33/664; H01H 33/666; H01H 33/6662; H01H 2033/66276; H01H 2033/66292
(Continued)

(56) References Cited

U.S. PATENT DOCUMENTS 3,021,407 A * 2/1962 Jennings ..... H01H 33/66207 218/134
3,727,018 A * 4/1973 Wesoloski ..... H01H 33/66207 218/134
(Continued)

FOREIGN PATENT DOCUMENTS

CN 101226847 * 7/2008 ..... H01H 33/66
DE 2815059 A1 12/1978
(Continued)

OTHER PUBLICATIONS

Translation of CN101226847 (Original document published Jul. 23, 2008) (Year: 2008).*
(Continued)

*Primary Examiner* — William A Bolton
(74) *Attorney, Agent, or Firm* — Laurence A. Greenberg; Werner H. Stemer; Ralph E. Locher

(57) ABSTRACT

A make contact system for high-voltage applications includes a vacuum switching tube having two switch contacts in the form of plate contacts, of which at least one is a moving contact coupled to a drive. At least one plate contact is rotationally symmetrically surrounded by a shielding element, and the shielding element has an electric conductivity which is less than $40\times10^{-6}$ S/m.

8 Claims, 3 Drawing Sheets

(52) U.S. Cl.
CPC ..... *H01H 2033/66269* (2013.01); *H01H 2033/66276* (2013.01); *H01H 2033/66292* (2013.01)

(58) Field of Classification Search
USPC ..... 218/136, 137, 139, 134
See application file for complete search history.

(56) References Cited

U.S. PATENT DOCUMENTS

| | | | | |
|---|---|---|---|---|
| 4,249,050 | A * | 2/1981 | Okumura | H01H 33/66261 218/147 |
| 4,431,885 | A * | 2/1984 | Sakuma | H01H 33/66238 218/135 |
| 4,574,169 | A * | 3/1986 | Santilli | H01H 33/66261 218/136 |
| 4,847,456 | A * | 7/1989 | Bamford | H01H 33/12 218/141 |
| 6,720,515 | B2 | 4/2004 | Renz et al. | |
| 8,445,805 | B2 * | 5/2013 | Glaser | H01H 33/166 218/140 |
| 10,032,581 | B2 * | 7/2018 | Bachmaier | H01H 33/666 |
| 10,720,285 | B2 | 7/2020 | Ebelsberger et al. | |
| 2007/0007250 | A1 * | 1/2007 | Li | H01H 33/66207 218/134 |
| 2012/0218672 | A1 | 8/2012 | Nunes et al. | |
| 2018/0075991 | A1 * | 3/2018 | Campbell | H01H 11/00 |

FOREIGN PATENT DOCUMENTS

| | | | |
|---|---|---|---|
| DE | 102018200450 | A1 | 7/2019 |
| EP | 2474086 | B1 | 4/2016 |
| WO | 0199132 | A1 | 12/2001 |
| WO | 2017194236 | A1 | 11/2017 |
| WO | 2018054615 | A1 | 3/2018 |

OTHER PUBLICATIONS

Translation of DE2815059 (Original document published Dec. 21, 1978) (Year: 1978).*

* cited by examiner

MAKE CONTACT SYSTEM

BACKGROUND OF THE INVENTION

Field of the Invention

Many high-voltage applications require rapid grounding of live parts, for example when a power grid fault occurs. An exemplary application is here the grounding of high-voltage cables in high-voltage direct-current transmission (HVDCT) systems or the bypassing of parts of the high-voltage arresters which are used there.

Such so-called quick-action grounding devices are usually made available in the prior art by gas-insulated switching systems (GIS). In many applications, for example in the direct-voltage field in HVDCT systems, the closing time of conventional quick-action grounding devices is too long, for which reason further technical expenditure has to be made in order to ensure that systems are protected.

SUMMARY OF THE INVENTION

The object of the invention is to shorten the closing time of make contact systems, in particular quick-action grounding devices, in the high-voltage range significantly in comparison with the prior art.

The means of achieving the object is a make contact system for high-voltage applications having the features described below.

The make contact system according to the invention for high-voltage applications is distinguished by the fact that a vacuum switching tube with two switching contacts which are configured in the form of plate contacts is provided. Of the plate contacts, at least one is configured as a so-called moving contact which is coupled to a drive. In addition, the make contact system is distinguished by the fact that at least one of the plate contacts is surrounded in a rotationally symmetrical fashion by a shielding element, wherein the shielding element has an electrical conductivity which is less than 40×10 6 S/m.

In the invention described, a plurality of measures which build on one another for the purpose of solving the described problem interact with one another. The first measure comprises the application of a vacuum switching tube in contrast to the gas-insulated switching which is used in the prior art. The vacuum switching tube comprises plate contacts which can be configured in a relatively simple fashion with respect to its geometry which require very small contact spacing owing to the high electrical insulation property and which are surrounded by the vacuum which is present in the vacuum switching tube. This in turn leads to the fact that in any case a relatively short switching distance has to be covered, which already significantly shortens the closing time. A further measure is that a shielding element is arranged around at least one of the plate contacts, wherein this shielding element already prevents a flashover and therefore permits the plate contacts to be brought closer together in the operating state, wherein in a further step the shielding element has a relatively low electrical conductivity, which according to the invention has proven expedient in reducing the distance between the two plate contacts even further.

The sum of these measures has the effect that the present make contact system for high-voltage applications has a significantly reduced closing time in comparison with the prior art, which means increased protection of the components which are at risk. The term plate contacts is understood here basically to mean plate-shaped contacts which preferably do not have geometries which control a magnetic field, but are also not harmful. Plate contacts are preferably simple contact systems which could be applied in the make contact system described, since these contacts only have to close and do not have to interrupt a flow of current.

It has become apparent that in particular a distance of 10 mm/100 kV rated voltage of the vacuum switching tube is a distance which is suitable for permitting very short closing times in comparison with the prior art. In this context it is expedient if an average closing speed of the contact or contacts which is/are moved during a closing process, that is to say the moving contact, is between 2 m/s and 8 m/s. Such closing speeds can be achieved by means of known drive systems.

A further feature which contributes to shortening the closing times between the plate contacts is the ratio between the distance between contact faces of the plate contacts to their diameter. This is preferably between X and Y, particularly preferably between V and W.

It has proven expedient if the at least one shielding element surrounds the moving contact. However, it can also be expedient also to provide a shielding element both for the moving contact and for the second contact, which is generally configured as a fixed contact. In this context, it can also be expedient that for at least part of the movement of the moving contact the shielding element is also moved along a switching axis which brings about better shielding during the switching process. The shielding element preferably has an electrical conductivity of $40\times10^{-6}$ S/m. The shielding element particularly preferably has a lower conductivity of $20\times10^{-6}$ S/m, which is ensured in particular when iron or an iron alloy, in particular stainless steel, is used.

In a further refinement of the invention the make contact system is distinguished in such a way that the drive has a coupling element which serves to prestress a cable rotation pendulum kinematic system, wherein in this kinematic system a rotational movement of a rotational body is converted into a translatory movement of a winding body using winding cables. The winding body serves to drive the moving contact, and the cable rotation pendulum kinematic system is suitable for making available very high switching speeds, wherein in addition the contacts are prevented from bouncing during the closing process.

Further refinements of the invention and further features are explained in more detail with reference to the following figures. These are purely exemplary refinements which are presented in a very schematic fashion in order to illustrate the features better, and these refinements therefore do not constitute a restriction of the scope of protection.

DETAILED DESCRIPTION OF THE INVENTION

Figure 1:
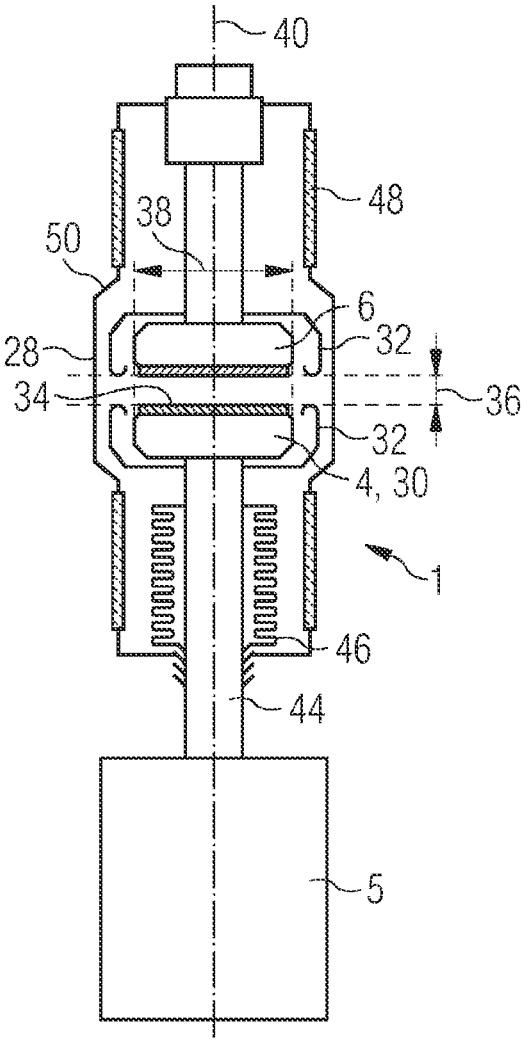
FIG. 1 shows a make contact system comprising a vacuum switching tube and a drive for achieving short closing times, in the opened state.

In FIG. 1, a make contact system 1 is illustrated which comprises a vacuum switching tube 28 and a drive 5. The vacuum switching tube 28 comprises here in turn a housing 50 which has, on the one hand, a plurality of insulator elements 48 and a metallic switching chamber 49, wherein a contact system 3 is arranged in the housing 50 of the vacuum switching tube 28. The contact system 3 comprises two switching contacts which are configured in the form of plate contacts 4 and 6. In the present FIG. 1, the first plate contact 4 is configured in the form of a moving contact 30. The plate contacts 4, 6 are contacts which have essentially circular contact faces 34 which are characterized here by a diameter 38. The contact faces 34 are in turn at a distance 36 from one another in an opened position. The moving contact 30 is provided with a contact pin 44 which is led out of the housing 50 of the vacuum switching tube 28 in an insulated fashion through a folding bellow 46, wherein the contact pin 44 is mechanically coupled to a drive 5, illustrated here only schematically. A possible refinement of the drive 5 is presented in detail in FIGS. 5 to 7.

When the vacuum switching tube 28 closes, in particular in the high-voltage range or else in medium-voltage applications, an arc (not illustrated here) is fired and a high flow of current occurs several millimeters before the plate contacts 4, 6 make contact. Depending on the height of the flow of current and its duration up to when contact is finally made, the arc starts to melt the contact faces 34. The molten contact faces 34 subsequently bounce against one another and in certain circumstances fuse. The melting is boosted if the contacts bounce. This bouncing occurs, in particular, at high closing speeds in conventional spring drives.

When the contacts subsequently open, these fused points, which can also be formed very locally, are torn apart and sharp edges and points are produced on the contact faces 34. These sharp edges and points, which tend to be in the microscopic range, give rise to excessive increases in the electrical field, which is equivalent to reducing the insulation capacity when plate contacts 4, 6 are opened. The insulation capacity can be reduced by the points in such a way that when there is a calculated flashover-free distance between the plate contacts 4, 6 in vacuum tubes according to the prior art, a flashover nevertheless takes place. This means that when designing the contact system 3 is it necessary also to introduce a corresponding safety distance which, however, in the present application also has to be bypassed during the closing process and as a result lengthens the closing time.

In order to avoid excessive increases in the field as a result of sharp edges and points which have come about as a cause of the fusing, a shielding element 32, which also acts as a potential ring, is provided around at least one, preferably around both contacts 4, 6. The shielding element 32 is preferably installed around the moving contact 4, 30 in an end position in the opened state. This is the illustration according to FIG. 1. More details are given on further arrangement possibilities of the shielding element 32 in FIGS. 2 to 4.

The shielding element 32 therefore at least essentially prevents the firing of an arc in the opened state despite the specified fusing and the resulting edges or points, meaning that the plate contacts 4, 6 can be positioned with smaller spacing 36 than is the case according to the prior art. The reduced spacing 36 contributes to a shorter switching time. A further contribution to shortening the switching time with an existing drive 5 is provided by the application of plate contacts 4, 6 which are particularly easily configured in comparison with other contact versions, for example tulip/pin contacts in gas-insulated switching systems, and owing to the lower mass achieve a relatively high closing speed given the same drive concept, said speed resulting in turn in a shorter closing time. The closing speed is preferably between 2 m/s and 8 m/s here. The plate contact 4, in particular the moving contact 30, can even be reduced further in terms of its mass by various measures. In this context, for example the contact pin 44 can be configured in a tubular shape, which brings about a reduced mass. A tubular configuration of the contact pin instead of a solid contact pin is possible in the present application as a make contact system in particular of a fast-action grounding device, since a current does not have to be conducted over a relatively long time. This contact pin 44 can also be configured from a lighter material, for example from graphite or a non-metal. The application of graphite, even as a coating of the contact pin 44, can contribute to improving the vacuum. The features which bring about the reduction in the mass of the moving contact 30 or of the contact pin 44, also give rise to less bounce of the contacts against one another during the closing process, which in turn results in less formation of fusing or the formation of points and edges.

A further measure for avoiding fusing is the use of a high-melt-point or high-temperature-resistant material which is arranged at least in the region of the contact faces 34 of the contacts 4, 6. In this context, it is appropriate to add bismuth, tungsten, titanium and/or zirconium, for example, as an alloy element of the contact material. This measure also reduces melting of the contact face 34 when the contacts 4, 6 approach one another.

It has proven expedient that the distance between the plate contacts 4, 6 in an opened state is not more than 10 mm/100 kV rated voltage of the vacuum switching tube 28. The described advantageous effects of the make contact system can be achieved with such small spacing 36. In particular, the spacing 36 should not be less than 8 mm/100 kV rated voltage. In this context it is expedient to make available a drive speed which is between 2 m/s and 8 m/s, which is made possible by a drive 5 according to FIGS. 5 to 7.

In addition it has been found that the ratio between the spacing 36 between the contact faces 34 of the plate contacts 2, 4 to their diameter 38 is between X and Y, preferably between V and W. This ratio between the spacing and the diameter is also suitable for suppressing the formation of an arc, and therefore also for preventing fusing and the formation of points and edges.

It has also proven expedient that the shielding element has an electrical conductivity which is less than that of copper. In particular, an electrical conductivity of the material of the shielding element of less than $40\times10^{-6}$ S/m leads to a situation in which, on the one hand, sufficient conductivity of the shielding element 32 is present, but on the other hand the formation of an arc is enduringly suppressed. The conductivity of the material of the shielding element 32, 33, which is less than $20\times10^{-6}$ S/m, is particularly advantageous, and an iron-based alloy or stainless steel is particularly expedient as the material of the shielding element 32, 33.

Figure 2:
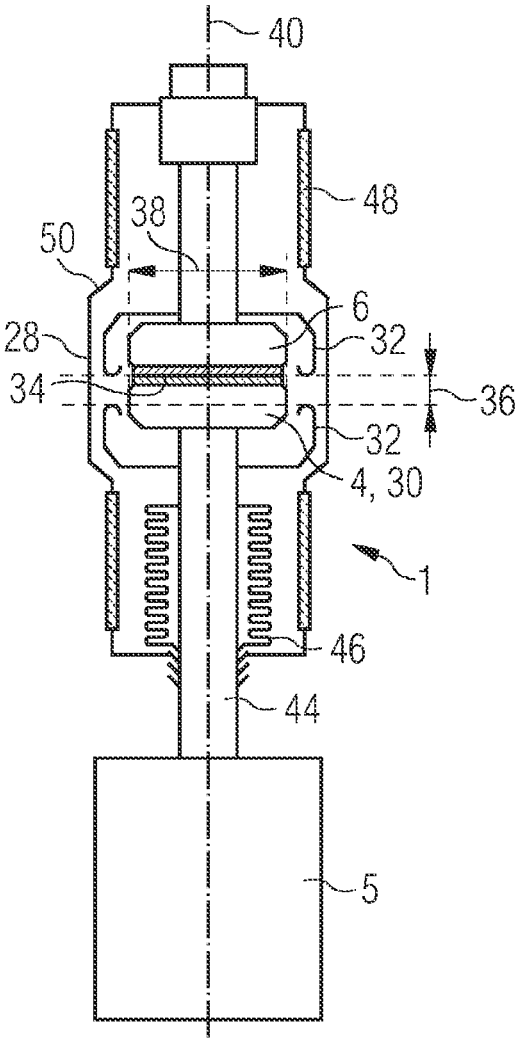
FIG. 2 shows a make contact system according to FIG. 1 in a closed state of the contacts.

In the description of the illustration according to FIGS. 2, 3 and 4, more details will now be given on the arrangement of the shielding element 32. FIG. 2 illustrates two shielding elements 32 which are fixedly positioned with respect to the switching axis, and which are additionally arranged in a rotationally symmetrical fashion about the plate contacts 4, 6 in the housing 50 of the vacuum switching tube 28. In an opened state of the contacts 4, 6, the moving contact 4, 30 is pulled back to such an extent that it terminates with an outer edge of the shielding element 32 with respect to a perpendicular to a switching axis 40, as a result of which particularly good shielding is achieved. When the moving contact 4, 30 is closed, the shielding element 32 which is described in FIG. 1 remains fixed, as depicted in FIG. 2.

Figure 3:
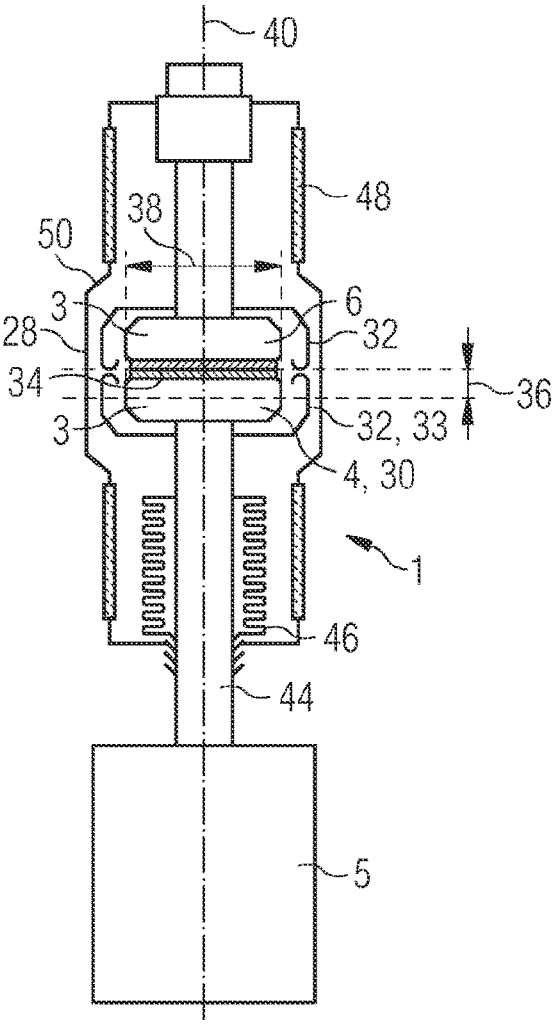
FIG. 3 shows a make contact system according to FIG. 2 with a shielding element which has been shifted along the switching axis.

One alternative consists in the shielding element 32, configured as a movable shielding element 33 in FIG. 3, also at least partially moving along with the contact pair 3 during their closing process. FIG. 3 shows a closed state of the contact pair 3, wherein the shielding elements 32 and 33 with the contacts 4, 6 are moved toward one another and virtually bear one against the other.

Figure 4:
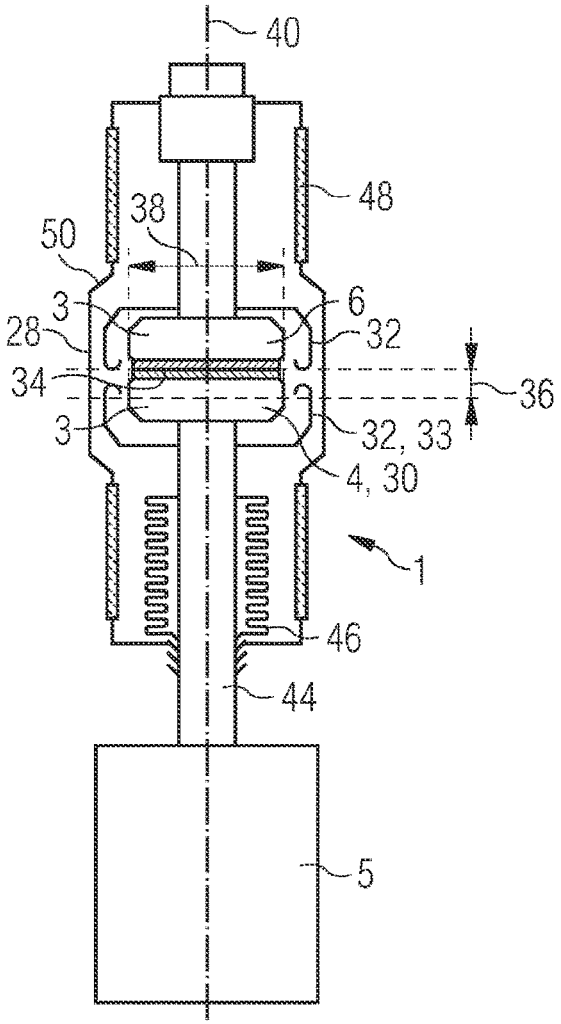
FIG. 4 shows a make contact system according to FIG. 3 with a further change in the position of the shielding element.

Depending on the shielding effect and the electrical fields which are calculated and those which are present it is also possible, as also illustrated in FIG. 4, to move along the moved shielding element 33 only part of the distance along the switching axis 40 during the closing process so that in the closed state of the contact system 3 the shielding elements 32, 33 are somewhat spaced apart from one another.

More details are given below by way of example on a possible drive 5 which is suitable for generating very high translatory speeds of the plate contacts, in the range from 2 m/s to 8 m/s. The core of the drive is a coupling element 2, described in more detail below, for prestressing a cable rotational pendulum kinematic system in which a rotational movement of a rotational body (10) is converted into a translatory movement of a winding body 8 using winding cables 16.

Figure 7:
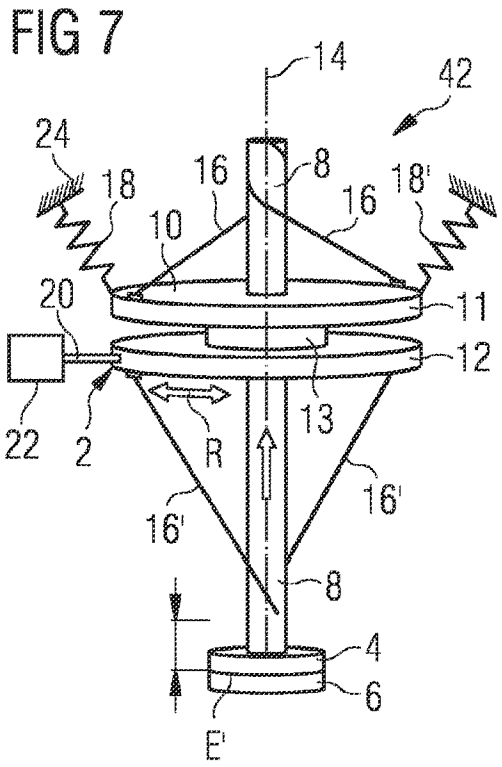
FIGS. 5-7 show a coupling element as part of the drive of the make contact system in different positions.
Figure 6:
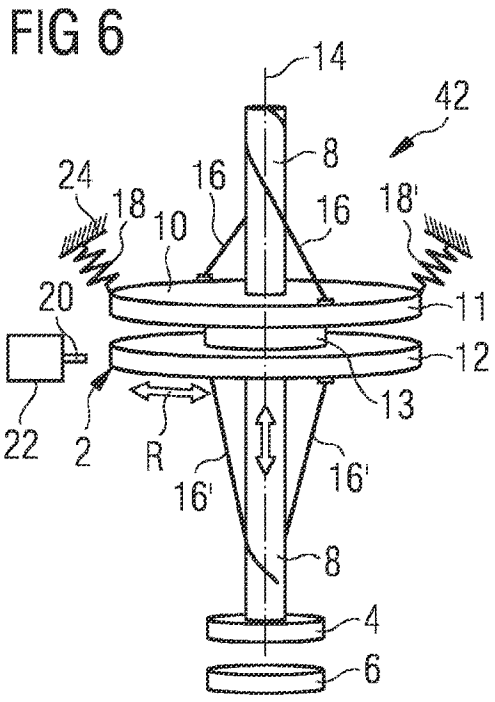
Figure 5:
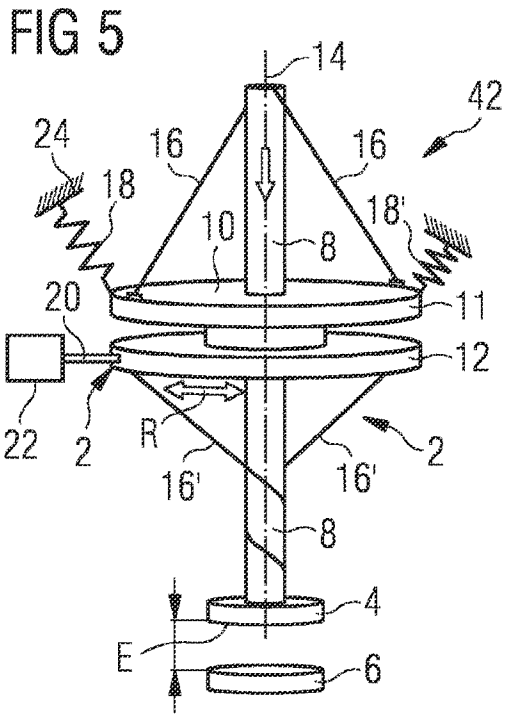

FIGS. 5 to 7 show a schematic configuration of a coupling element 2. The coupling element 2 is used to activate the contact system 3, composed of the plate contacts in the form of plate contacts 4 and 6, for which purpose the plate contact 4 is moved relative to the plate contact 6. The contact pair 3, comprising the plate contacts 4, 6, is a contact pair such as has already been explained schematically in FIGS. 1 to 4. When the two plate contacts 4 and 6 come into contact, a circuit is closed and a flow of current is brought about across the electrically conductive, rod-shaped winding body 8 explained further below and the contact system of the plate contacts 4 and 6. This flow of current can be interrupted again by opening the contact system by moving apart the two plate contacts 4 and 6.

The plate contact 4, which is configured in the form of the moving contact 30, is mechanically coupled to the lower end of the winding body 8, which is also referred to as a winding rod below). In FIGS. 5 to 7, the plate contact 4 is illustrated directly at the lower end of the winding body 8, which is a simplified illustration which serves to show the direct effect of the kinematics on the movement of the contacts 4, 30. Basically, given the specified coupling it is also possible to interconnect further components such as the contact pin 44 between the winding body 8 and the plate contact 4, 30. However, it is also possible that sections of the winding body 8 serve as contact pins 44. The winding body 8 is linear, that is to say can be displaced in a translatory fashion, wherein it is guided along its longitudinal axis 14, but cannot be rotated in the process. However, the longitudinal axis 14 preferably does not necessarily coincide with the switching axis 40.

A rotational body 10 is rotatably mounted on the winding body 8, i.e. the rotational body can rotate on the winding body. For this purpose, the rotational body 10 has a drilled hole through which the rod-shaped winding body 8 projects. A bearing 13 is provided between the winding body 8 and the rotational body 10 here, so that the rotation of the rotational body 10 occurs as far as possible without friction and with low loss.

The rotational body 10 comprises here in this example two disks or plates 11 and 12 which are spaced apart from one another. In this embodiment, the bearing 13 is illustrated schematically between these two plates 11 and 12 of the rotational body, which is intended to illustrate that the rotational body 10 is rotatably mounted on the winding body 8.

FIG. 5 illustrates a position of the coupling element 2, wherein the contacts 4 and 6 are opened at their greatest distance from one another. This distance is denoted by the end position E with respect to the position of the contact 4, 30. FIG. 6 shows a central position between the end position E and the end position E' which is illustrated in FIG. 7 and in which the contacts 4, 30 and 6 are closed and current can flow via the contacts.

Starting with the position of the end position E in FIG. 5, the closing process of the coupling element 2 will now be described. It also has to be explained here that the rotational body 10 is coupled to two springs 18 in this case. The springs 18 are configured for tensile loading and are attached here by one end to the rotational body 10 and are secured by another end to a securing point 24 outside the coupling element 2. At the end position E, at which a spring 18 has greater prestress than the spring 18', a locking means 20 is provided which is in turn connected to an actuator 22. The locking means 20 is illustrated in this case very schematically by a rod, and the locking means 20 can be configured, for example, in the form of two toothed rings which engage one in the other, which is not illustrated here explicitly for the sake of better clarity.

In addition, the coupling element comprises winding cables 16 and 16' which are attached, preferably provided with a certain amount of prestress, between the rotational body 10 and the winding body 8. The cables 16 are each fastened here to the winding body 8 and attached to a second attachment point as far as possible on the outside of the disks 11 and 12 and to the upper and lower plates 11 and 12 of the rotational body 10. Cables are understood here to be in their entirety flexible structures such as, for example, cords, wire cables or aramid fibers which have, on the one hand, a high modulus of elasticity in order to bring about the most secure prestressing possible between the winding body 8 and the rotational body 10.

In the example according to FIG. 5, the cables 16' are wound several revolutions around the winding body in the lower region between the plate 12 of the rotational body 10 and the plate contact 4. In the upper region of the coupling element 2, that is to say above the plate 11 of the rotational body 10, the cables 16 are not rotated in the position of the end position E according to FIG. 5. If the locking means 20 is opened, for example caused by a signal which is passed on to the actuator 22, the prestressing of the springs 18 and 18', which are configured overall in such a way that a resonator is produced, a rotational movement of the rotational body is generated, as a result of which the cables 16' in the lower region of the winding body 8 unroll and on the other hand the cables 16 in the upper region, above the rotational body 10, are wound onto the winding body 8. This position is illustrated in FIG. 6. In the position according to FIG. 6, the springs 18 and 18' are also essentially in a position of equilibrium, in which case prestress of the springs 18 and 18' is also present here. This position of equilibrium according to FIG. 6 is overcome owing to the effect of the two springs as a resonator, and according to FIG. 7 the position of the end position E' occurs in which the two plate contacts 4, 30 and 6 are closed.

In this context, the system is configured with respect to the prestresses of the individual springs 18 and 18' in such a way that not only is contact formed between the contacts 4 and 6 but also an offset force, that is to say an additional pressing force, acts on the plate contact 6 as a result of the winding body 8 and the plate contact 4, 30. When the end position E' is reached, the locking means 20 engages, triggered once more by the actuator 22, in the rotational body 10 so that the position of the rotational body 10 is maintained.

During the movement sequence, illustrated between FIGS. 5 and 7, it is shown how a rotational movement is converted into a translatory movement of the winding body 8, and therefore also the switching contact 4 is converted, by winding of the cables 16 through the rotation of the rotational body 10. The translatory, and also linear, movement of the winding body 8 can take place in both directions. The closing process which is described here can be described in a reversible fashion starting from FIG. 7 via the position in FIG. 6 back to FIG. 5, wherein a translatory movement of the winding body 8 is completed along its longitudinal axis 14 in the direction of the end position E.

Since the spring pair 18 and 18' acts as a resonator, this movement can occur very frequently without large frictional losses. The frictional losses are therefore very low since the friction which is transmitted via the cables 16 and 16' is also low and the rotational body is supported as well as possible with respect to the winding body 8. Helical springs are illustrated here as springs 18, 18' in a purely schematic fashion, but other types of springs such as spiral springs or gas pressure springs, which can also be embodied in a rotational fashion and integrated into the winding body, can be applied.

The rotational movement of the rotational body 10 is configured here in such a way that during an opening process and a closing process the rotational body 10 respectively carries out a rotation of approximately 90° in each direction. In this context, the switching time, that is to say the time which the coupling element requires to move from the end position E' into the end position E, and vice versa, is dependent on the rigidity of the springs 18 used and on the inertia, that is to say the mass of the rotational body 10, which also functions as a flywheel. The angular speed Q of the rotational body 10 is directly proportional here to the root of the ratio of the spring stiffness, that is to say the spring constant K, and the mass m of the rotational body 10, expressed by way of example by the equation $\Omega \sim (K/m)^{0.5}$.

In this context the energy of the rotational body is set in such a way that the desired Ω, that is to say the desired angular speed and the desired switching time are obtained for the respective switching process, wherein approximately 95% of the total energy of the system is input into the switching process. As a result of the described switching system or coupling element which operates with very low loss, approximately 1.5 J of energy is lost in the system in this context in an exemplary switching process. In a conventional switching process with a conventional drive, 20 to 30 times the amount of energy is lost per switching process with the same power and a comparable size of the coupling element. This means that when the two plate contacts 4 and 6 impact, this energy is lost, with the result that in what is referred to as a bouncing process this energy separates the plate contacts from one another repeatedly and brings them together again in the microscopic range, in a similar way to a hammer which is struck against an anvil. This bouncing process is extremely undesirable when switching the high-voltage system, since it prevents a uniform and rapid establishment of contact from occurring. As a result, this bouncing process is reduced to a minimum by the coupling element according to FIGS. 5 to 7, which operates with low loss in energetic terms.

LIST OF REFERENCE NUMBERS

1 Make contact system
2 Coupling element
3 Contact pair
4 First switching contact
5 Drive
6 Second switching contact
8 Rod-shaped winding body
10 Rotational body
11 One plate of rotational body
12 Second plate of rotational body
13 Bearing
14 Longitudinal axis
16 Plate
18 Springs
20 Locking means
22 Actuator
24 Attachment point spring
28 Vacuum switching tube
30 Moving contact
32 Shielding element
33 Movably mounted shield
34 Contact faces
36 Distance between contact faces
38 Diameter of contact faces
40 Switching axis
42 Cable rotational pendulum kinematic system
44 Contact pin
46 Folding bellows
48 Insulator
49 Metallic switching chamber
50 Housing

The invention claimed is:

1. A make contact system for high-voltage applications, the make contact system comprising:

a drive;

a vacuum switching tube having two switch contacts formed as plate contacts, at least one of said plate contacts being a moving contact coupled to said drive; and a shielding element rotationally symmetrically surrounding at least one of said plate contacts, said shielding element having an electrical conductivity of less than $40\times10^{-6}$ S/m on an iron basis;

said plate contacts being spaced apart by a distance of less than 10 mm per 100 kV rated voltage in an opened state of said plate contacts.

2. The make contact system according to claim 1, wherein said at least one moving plate contact has an average closing speed of between 2 m/s and 8 m/s during a movement of said at least one moving plate contact.

3. The make contact system according to claim 1, wherein said shielding element surrounds said moving contact.

4. The make contact system according to claim 3, wherein said shielding element is mounted to be movable along a switching axis.

5. The make contact system according to claim 1, wherein said electrical conductivity of said shielding element is less than $20\times10^{-6}$ S/m.

6. The make contact system according to claim 1, wherein said distance between contact faces of said plate contacts is less than 8 mm per 100 kV rated voltage in said opened state of said plate contacts.

7. The make contact system according to claim 1, wherein said shielding element is formed of an iron alloy.

8. The make contact system according to claim 1, wherein said drive includes:

a rotational body;

a winding body;

winding cables;

a cable rotational pendulum kinematic system converting a rotational movement of said rotational body into a translatory movement of said winding body using said winding cables; and a coupling element for prestressing said cable rotational pendulum kinematic system.

* * * * *